United States Patent [19]

Desthieux

[11] 4,446,673

[45] May 8, 1984

[54] BOTTLE-FILLING METHOD AND DEVICE

[76] Inventor: Johannes Desthieux, 1083, rue de Thizy, Gleize (Rhone), France

[21] Appl. No.: 378,414

[22] Filed: May 14, 1982

[30] Foreign Application Priority Data

May 15, 1981 [FR] France ..... 81 10095

[51] Int. Cl.[3] ..... B65B 3/06; B65B 7/28; B67B 1/04; B67B 7/02

[52] U.S. Cl. ..... 53/467; 53/468; 53/489; 53/492; 53/319; 53/381 A; 53/390; 215/296; 222/105

[58] Field of Search ..... 53/468, 471, 492, 381 A, 53/268, 281, 319, 489, 390; 222/105; 215/296, 302

[56] References Cited

U.S. PATENT DOCUMENTS 3,842,790 10/1974 Clark ..... 215/296 X
3,937,347 2/1976 Cottingham ..... 215/296 X
3,970,207 7/1976 Faulstich ..... 215/302 X
4,364,486 12/1982 Korte et al. ..... 215/296

FOREIGN PATENT DOCUMENTS 235025 4/1959 Australia .
1025 of 1876 United Kingdom ..... 53/471

*Primary Examiner*—Horace M. Culver
*Attorney, Agent, or Firm*—Karl F. Ross

[57] ABSTRACT

A tap attachable to a spout of a container for decanting a liquid such as wine into bottles has a rotary valve housing and a valve body provided with a detachable handle, part of that valve body being a tubular spigot fitting into a transverse bore of the valve housing to fill a bottle aligned with that bore. The spigot, when withdrawn from the bore after removal of the tap from the spout and plugging of the latter, is receivable in an internally threaded plastic cap for forcing it into the neck of a freshly filled bottle; to unseal the bottle, a complementarily threaded extremity of the handle detached from the valve body is screwed into the cap for extracting same.

12 Claims, 12 Drawing Figures

PRIOR ART
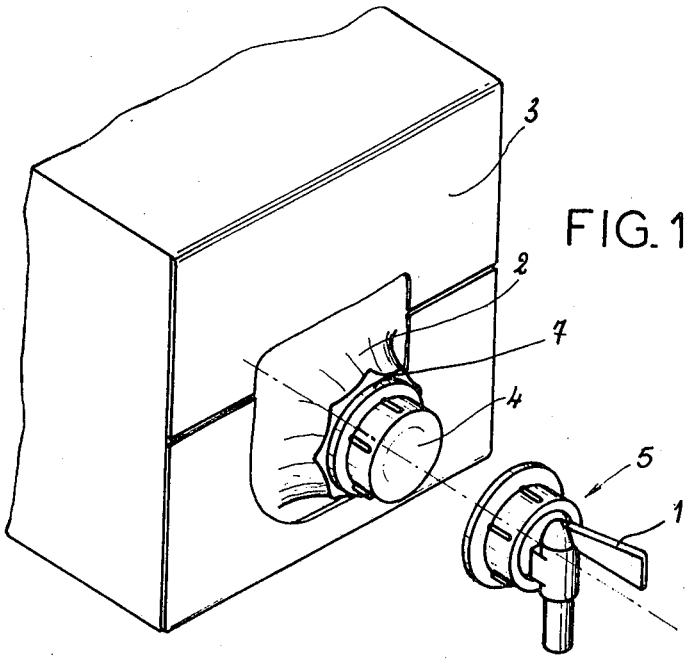
FIG. 1
FIG. 2
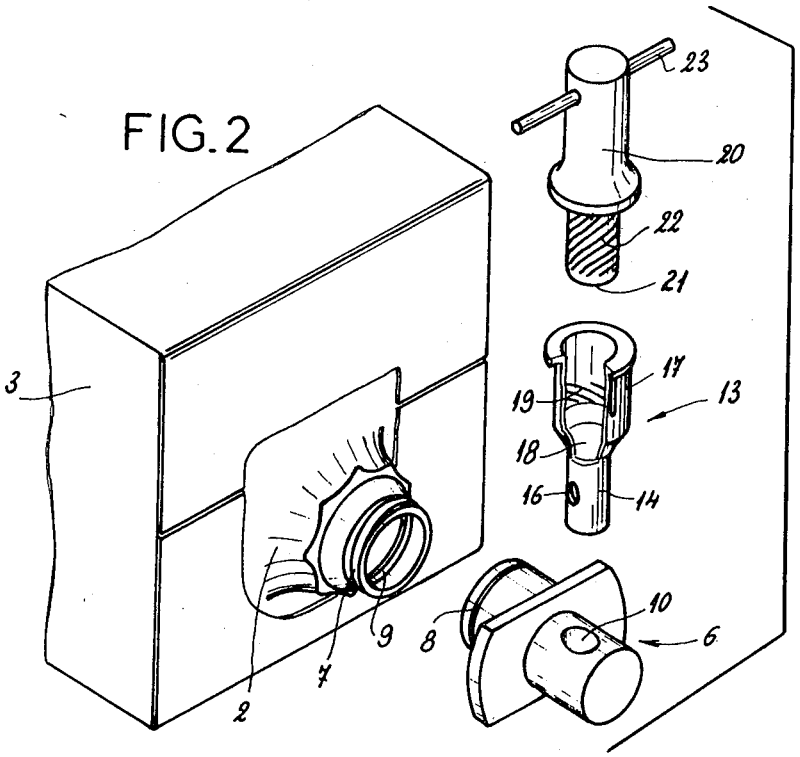

FIG. 3
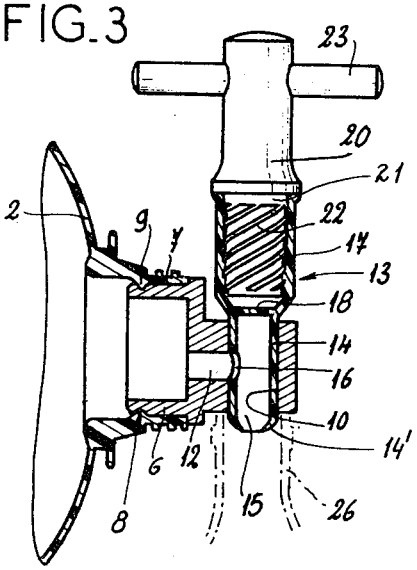
FIG. 4
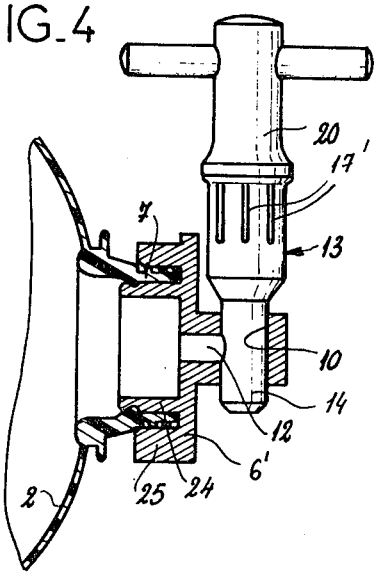
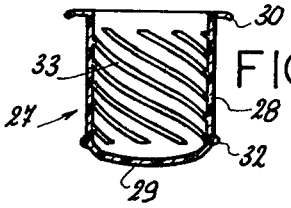
FIG. 5
FIG. 6
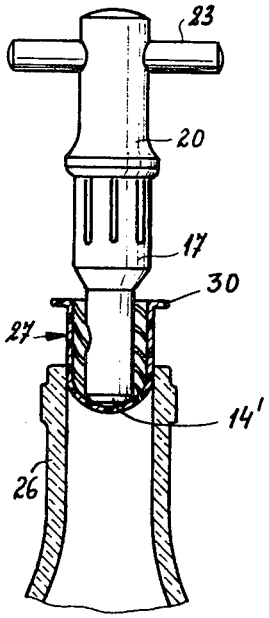
FIG. 7
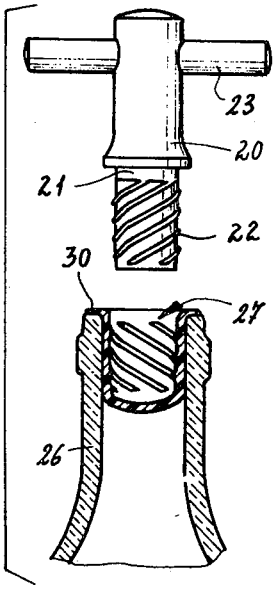
FIG. 8
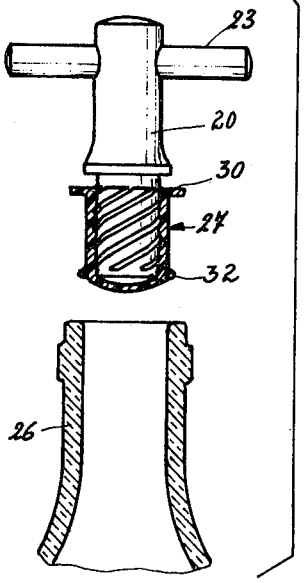

BOTTLE-FILLING METHOD AND DEVICE

FIELD OF THE INVENTION

My present invention relates to a method of sealing and unsealing bottles after filling same with a liquid decanted from a container, and to a device facilitating both the decanting of the liquid into such bottles and their subsequent sealing and unsealing.

BACKGROUND OF THE INVENTION

Various liquids, especially wines of general consumption, are often shipped in large containers, such as flasks or canisters of flexible plastic material, placed in crush-proof cardboard boxes. During transportation and storage, the containers are in an upright position and their spouts are closed by plugs that can be replaced by spigots or taps for decantation of their contents when the boxes have been tilted or laid on one side. After filling, the bottles are usually sealed with corks which are rather expensive and require a special applicator for their insertion into the bottle neck. Corkscrews are generally required for the subsequent extraction of the corks which as a rule are not reusable.

OBJECTS OF THE INVENTION

An important object of my present invention, therefore, is to provide a simple and inexpensive device adapted to be used, e.g. by a skinker or wine steward, not only for filling bottles but also for sealing and unsealing same.

A related object of my invention is to provide an economical method of filling, sealing and unsealing bottles with the aid of one and the same implement.

SUMMARY OF THE INVENTION

A device according to my invention comprises a tap consisting essentially of a valve housing attachable to a container spout and a valve body with a detachable handle. The valve body includes a tubular spigot removably fitted into a transverse bore in the valve housing alignable with a neck of a bottle to be filled. An extension of the spigot is engageable with positive fit by a stem of the handle for joint rotation therewith when the handle is turned by the user to open or close a discharge path through the valve housing. A stopper for sealing a bottle comprises a resiliently deformable cap having a closed lower end and an open upper end wide enough to receive the spigot upon removal of the handle together with the valve body from the bore of the valve housing. The cap can thus be pushed by an end of the spigot down the neck of a freshly filled bottle to be sealed; internal formations in its open end are engageable by mating formations such as complementary screw threads on the stem of the handle when the latter is detached from the valve body. The handle, therefore, acts as an extractor designed to withdraw such a cap from the neck of a bottle to be unsealed.

According to an advantageous feature of my invention, the stem-engaging extension of the spigot is formed as a cup-shaped head accommodating an extremity of the stem; this head, of course, is closed against an inner channel of the spigot forming part of the discharge path for the liquid to be decanted. The head and the stem extremity should be provided with interfitting coupling formations which may include female threads in the head mating with cap-engaging male threads on that extremity. For positive bidirectional rotary entrainment. however, other formations may be used as more fully discussed hereinafter.

The aforedescribed tap with its separable spigot and handle can therefore be used for the filling of a bottle as well as for its subsequent capping and uncapping. The closure cap itself, made of suitable plastic material, will be reusable an indefinite number of times thanks to its nondestructive removal from the bottle by the valve handle.

BRIEF DESCRIPTION OF THE DRAWING

The above and other features of my invention will now be described in detail with reference to the accompanying drawing in which:

FIG. 1 is a perspective view illustrating a container and a conventional tap for decanting a liquid therefrom;

FIG. 2 is an exploded perspective view of a tap according to my present invention, shown juxtaposed with the container of FIG. 1;

FIG. 3 is a partly sectional view of the assembled tap of FIG. 2 in an open position for decanting liquid from the container;

FIG. 4 is a view similar to FIG. 3, showing a modification of the tap;

FIG. 5 is an axial sectional view of a bottle-sealing cap;

FIGS. 6–8 are partly sectional views showing the sealing of a bottle with the cap of FIG. 5 and its unsealing with the aid of parts of a tap such as that shown in FIGS. 2–4;

SPECIFIC DESCRIPTION

Figure 9:
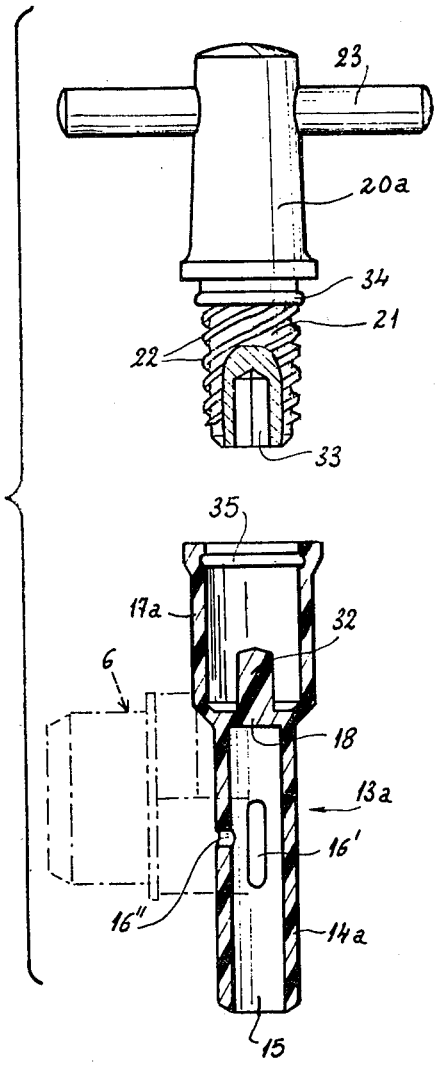
FIGS. 9 and 10 are partly sectional views showing a modified valve body in disassembled and assembled position, respectively.

FIG. 1 shows part of a container 2, such as a wine flask, having a spout 7 projecting from a box 3 of cardboard or the like, this spout being normally closed by a plug 4. In order to decant the liquid from the container 2 into bottles, a conventional tap 5 with a swiveling spigot 1 is attached to the spout 7 in place of the plug 4 whereafter the box 3 with the container 2 is tilted into its illustrated recumbent position. The spigot 1, even if removable from the tap body designed as a valve housing, has only the function of opening and closing a discharge path for the contents of the associated container 2.

In FIGS. 2 and 3 I have shown a tap according to the present invention whose valve housing 6 is attachable to the spout 7 of the container 2 in a fluidtight manner by engagement of a rim 8 of the spout in an annular groove 9 of that valve housing. The latter has an axial passage 12 opening into a radial bore 10 which is alignable with a neck of a bottle 26 to be filled with a liquid decanted from the container 2. The bore 10 forms a seat for a tubular spigot 14 of a valve body 13 which is provided with a detachable handle 20 having a cross-bar 23 to facilitate its manual rotation for selectively opening and closing the discharge path from the container 2; this path is defined by the passage 12, a lateral port 16 in spigot 14 and a central channel 15 having an outlet at the lower end 14' of the spigot. A cup-shaped head 14 of valve body 13, whose interior is separated from channel 15 by a partition 18, is engageable with positive fit by a stem 2 of the handle 20 for joint rotation therewith around a common central axis. The stem 21 has helicoidal outer ribs 22 forming male threads engageable with respective inner threads 19 formed by similar ribs in the head 17. The outer surface of head 17 is provided with ribs 17' (see FIG. 4) facilitating the attachment of the valve body 13 to the handle 20.

For filling the bottle 26 with liquid from the container 2, the neck of that bottle is disposed underneath the lower end 14' of the spigot 14 and the handle 20 is turned to align the lateral port or aperture 16 with the passage 12 in valve housing 6. After the bottle 26 has been filled, the handle 20 is rotated together with the valve body 13 to reblock the passage 12. The container 2 with its carton 3 is then erected to allow a removal of spigot 14 from bore 10.

As shown in FIG. 4, a slightly modified tap includes two coaxial skirts 24 and 25 on a valve housing 6' designed to embrace the spout 7 from both the inside and the outside.

In order to seal a freshly filled bottle, a cap 27, shown in FIG. 5, is to be used. This cap, made of flexible plastic material, has a cylindrical wall 28 provided with a closed lower end 29, an annular outer flange 30 on its open upper end, internal threads 33, and an annular rib 32 surrounding its closed end. The female threads 33 of the cap 27 are adapted to mate with the male threads of the stem 22 of the handle 20. The inner diameter of cap 27 is slightly larger than the outer diameter of spigot 14.

As illustrated in FIG. 6, the freshly filled bottle 26 is sealed by the insertion of cap 27 into its neck whereupon the convex lower end 14' of spigot 14 is inserted into the open end of the cap 27 for thrusting same down until the outer flange 30 abuts the top of the neck. The inserted plastic cap 27 snugly fits in the neck of bottle 26 as a temporary seal.

In order to unseal the bottle 26, the handle 20 is detached from the valve body 13 and, as shown in FIGS. 7 and 8, its threaded stem 22 is screwed into the open end of the cap 27 for extracting it from the bottle 26, the cap then resiliently regaining its original shape so as to be available for subsequent reuse.

Figure 10:
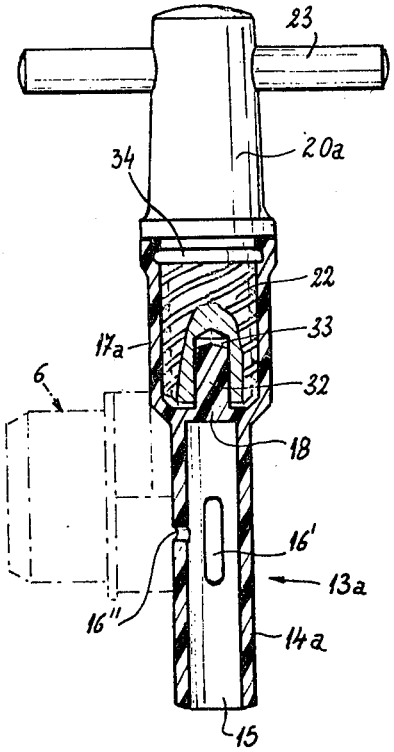

A modified valve body **13*a*, shown in FIGS. 9 and 10, includes a polygonal stud 32 rising axially within its head 17*a* for engagement in a central socket 33 provided in the stem of a coacting handle 20*a*. This handle further has an annular bead 34 designed to be engaged by a complementarily grooved mouth 35 at the top of head 17*a* to enable positive bidirectional rotary entrainment of the valve body 13*a* by handle 20*a*** without affecting their axial separability.

The spigot **14*a* of valve body 13*a* is shown provided with lateral ports or apertures 16' and 16'' of different cross-sectional areas selectively alignable with passage 12 (FIGS. 3 and 4) to enable a change in the rate of flow from the container into a bottle, e.g. in accordance with the capacity of the latter. Such rate-changing apertures or ports could, of course, also be used on the spigot 14 of FIGS. 3 and 4**.

Figure 11:
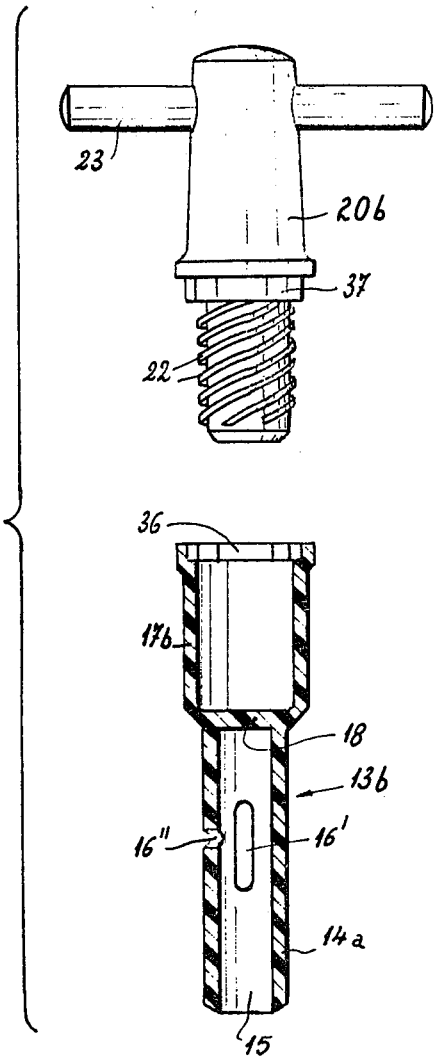
FIGS. 11 and 12 are views similar to FIG. 9, showing further modifications.

FIG. 11 shows a handle **20*b* and a valve body 13*b* having bidirectionally effective coupling formations designed as a rim 36 with a polygonal inner periphery on the head 17*b* and a complementary polygonal collar 37** at the top of the threaded stem of the handle.

Figure 12:
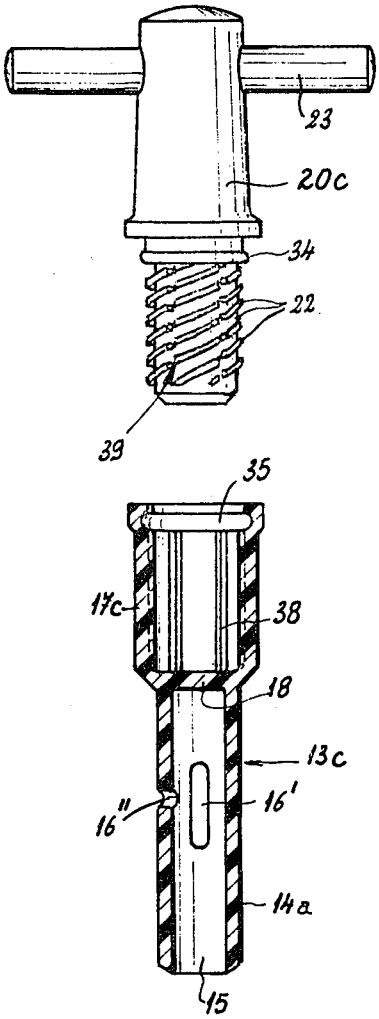

In FIG. 12 a handle **20*c* and a coacting valve body 13*c* have coupling formations in the shape of a group of ribs 38, extending at the inner peripheral wall of the head 17*c* parallel to its axis, and aligned notches 39 interrupting the threads 22 on the stem of the handle. Here, again, the handle stem carries an annular bead 34 receivable with a snap fit in a peripheral groove 34 of head 17*c***. For such a snap fit, of course, the valve body or at least its head should also consist of a resiliently deformable plastic material.

I claim:

1. In combination, a tap attachable to a spout of a container for decanting a liquid therefrom into a bottle and a stopper insertable into a neck of such bottle for temporarily sealing same, said tap comprising a valve housing attachable to the container spout and a valve body with a detachable handle coacting with said valve housing for selectively opening and closing a discharge path therethrough, said valve housing having a transverse bore alignable with the neck of a bottle to be filled, said valve body including a tubular spigot removably fitting into said bore and an extension of said spigot engageable with positive fit by a stem of said handle for rotary entrainment thereby, said stopper comprising a resiliently deformable cap with a closed lower end and with an open upper end capable of receiving said spigot upon removal of the latter from said bore for enabling the closed end of the cap to be thrust down the neck of a freshly filled bottle by the handle still attached to said valve body, the open end of said cap having internal formations engageable by mating formations on said stem upon detachment of said handle from said valve body for facilitating an extraction of said cap from said neck.

2. The combination defined in claim 1 wherein said internal and mating formations are complementary female and male threads.

3. The combination defined in claim 2 wherein said extension is a cup-shaped head accommodating an extremity of said stem provided with said male threads.

4. The combination defined in claim 3 wherein said head is provided with internal threads mating with said male threads.

5. The combination defined in claim 3 wherein said head and said extremity are provided with interfitting coupling formations for bidirectional rotary entrainment of said valve body by said handle.

6. The combination defined in claim 5 wherein said coupling formations include a polygonal stud rising axially within said head and a complementary central socket in said extremity.

7. The combination defined in claim 5 wherein said coupling formations include a rim with a noncircular inner periphery on said head and a complementarily noncircular collar on said stem adjoining said extremity.

8. The combination defined in claim 5 wherein said coupling formations include a plurality of axially extending ribs on an inner peripheral surface of said head and aligned notches in said male threads penetrable by said ribs.

9. The combination defined in claim 6 or 8 wherein said head is elastically deformable, said coupling formations further including an annular bead on said stem adjacent said extremity and a complementarily grooved mouth on said head.

10. The combination defined in claim 1, 2 or 3 wherein said spigot has a plurality of lateral apertures of different cross-sections selectively positionable to communicate with said spout via the interior of said valve housing.

11. The combination defined in claim 1, 2 or 3 wherein said cap is provided at said open end with an outer flange limiting the insertion of the closed end thereof into said neck.

12. A method of sealing and unsealing a bottle after filling same with a liquid decanted from a container through a tap attached to a spout of said container, said tap having a valve housing provided with a removable valve body which includes a tubular spigot and a handle separable from each other, comprising the steps of:

providing a resiliently deformable cap with a closed lower end insertable as a stopper into the neck of a freshly filled bottle and with an open upper end slightly wider than said spigot, said handle having a stem receivable with a positive fit in said open end upon separation from said valve body;

introducing the spigot into said open end and, with the handle still attached to the valve body, using the combined handle and valve body as a tool for forcing the closed end of the cap down the neck of the bottle;

separating the handle from the valve body; and subsequently introducing the stem of the handle into the open end of said cap for extracting same from the neck of the bottle with the aid of mating formations on said stem and in said cap.

* * * * *